US005123814A

United States Patent [19]

Burdick et al.

[11] Patent Number: 5,123,814

[45] Date of Patent: Jun. 23, 1992

[54] INDUSTRIAL COOLING TOWER FAN BLADE HAVING ABRASION RESISTANT LEADING EDGE

[75] Inventors: Larry F. Burdick, Olathe; Scott E. Mayes, Lenexa, both of Kans.

[73] Assignee: The Marley Cooling Tower Company, Mission, Kans.

[21] Appl. No.: 558,770

[22] Filed: Jul. 27, 1990

[51] Int. Cl.[5] ..... F04D 29/38

[52] U.S. Cl. ..... 416/224; 416/230; 416/241 A; 29/889.3; 29/889.71

[58] Field of Search ..... 416/224, 226, 229 R, 416/230, 241 R, 241 A; 29/889.3, 889.7, 889.71

[56] References Cited

U.S. PATENT DOCUMENTS

| | | | |
|---|---|---|---|
| 1,364,197 | 1/1921 | Heath | 416/224 |
| 2,312,219 | 2/1943 | Sensenich | 416/224 |
| 2,431,184 | 11/1947 | Martin | 416/224 |
| 2,767,461 | 10/1956 | Lebold et al. | 416/229 R |
| 3,178,560 | 4/1965 | Mapp et al. | 416/224 |
| 3,647,317 | 3/1972 | Furlong et al. | 416/226 |
| 4,720,244 | 1/1988 | Kluppel et al. | 416/224 |
| 4,738,594 | 4/1988 | Sato et al. | 416/224 |
| 4,842,663 | 6/1989 | Kramer | 416/224 |
| 4,895,491 | 1/1990 | Cross et al. | 416/224 |

FOREIGN PATENT DOCUMENTS

| | | | |
|---|---|---|---|
| 732555 | 5/1980 | U.S.S.R. | 416/224 |
| 2039526 | 8/1980 | United Kingdom | 416/224 |

*Primary Examiner*—Edward K. Look
*Assistant Examiner*—James A. Larson
*Attorney, Agent, or Firm*—Hovey, Williams, Timmons & Collins

[57] ABSTRACT

An elongated, flexible protective urethane member is bonded and firmly affixed to the leading edge of a glass fiber reinforced polyester skin fan blade for large diameter industrial water cooling tower fans. The polyester blade without such protective member would be subject to leading edge abrasion and deterioration during use. The flexible protective member is applied to the blade prior to curing of the chemically thickened polyester skin. Firm bonding and adherence of the protective member to the leading edge of the blade skin is obtained by curing of the skin with the protective member in place over the leading edge of the blade. Mechanical connection of the urethane member to the polyeste blade body is accomplished by provision of a series of holes along opposed longitudinal margins of the member which allow fluid polyester resin to flow into such openings during cure of the blade body resin layers, and by application of a glass fiber reinforced synthetic resin hold-down strip over opposed longitudinally extending edges of the hold-down strips and adjacent areas of the blade skin. Thus, upon completion of the cure cyle, the polyester resin within the openings cross-links with the underlying resin material and the overlying hold-down strips to more securely lock the member to the blade body.

17 Claims, 1 Drawing Sheet

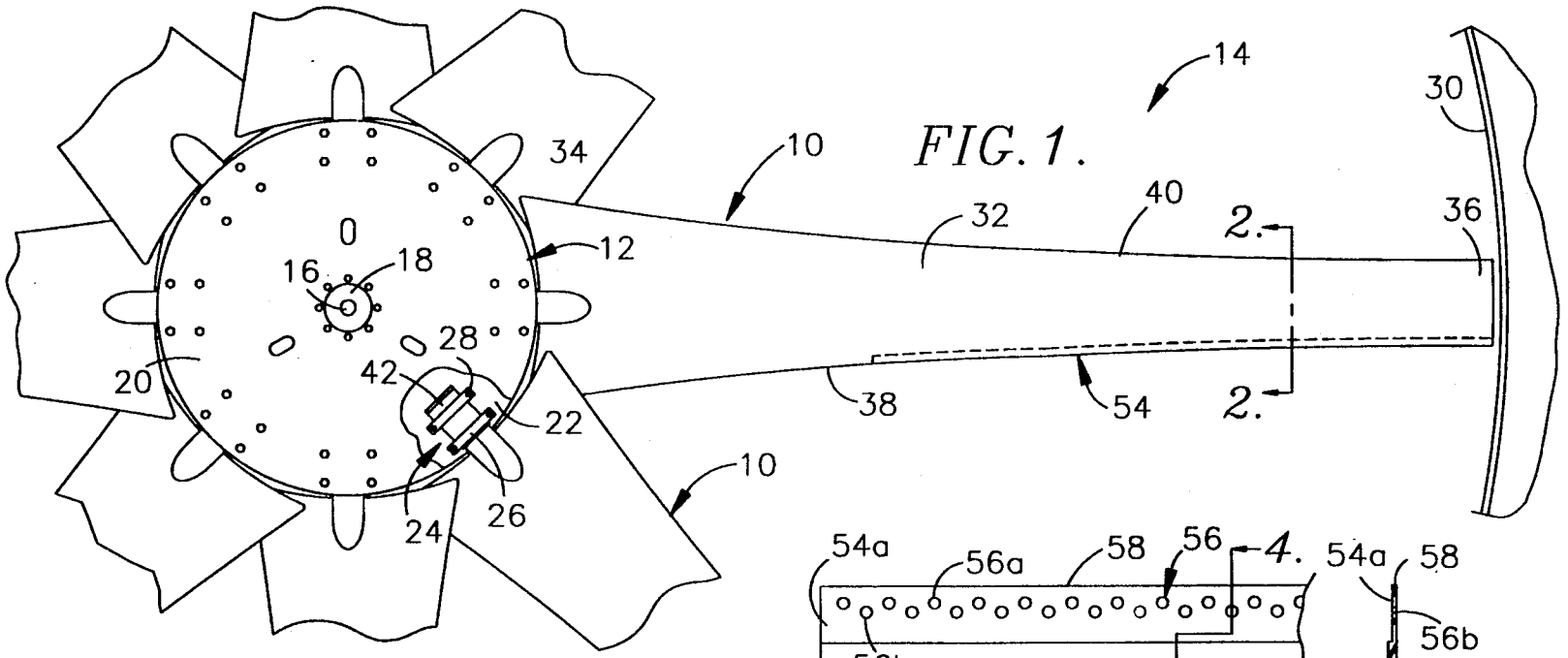
FIG. 1.
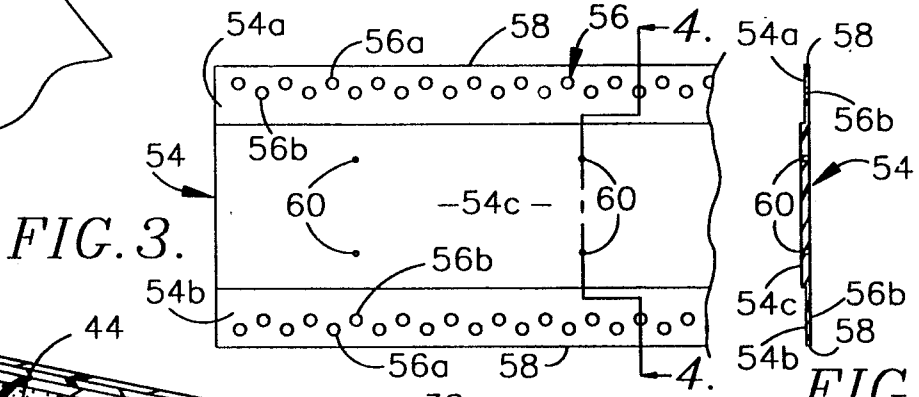
FIG. 4.
FIG. 3.
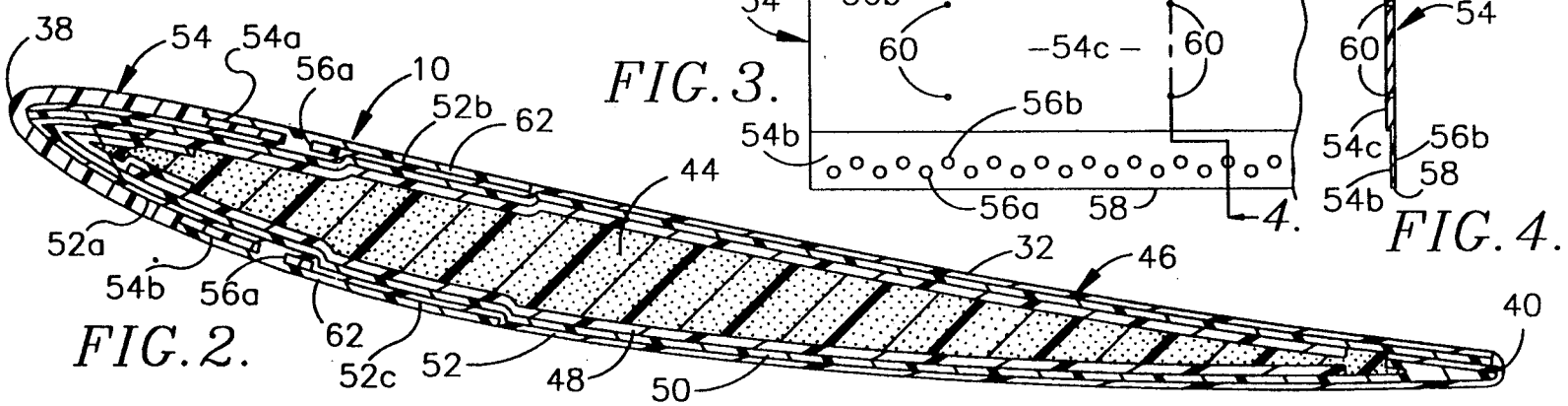
FIG. 2.

INDUSTRIAL COOLING TOWER FAN BLADE HAVING ABRASION RESISTANT LEADING EDGE

BACKGROUND OF THE INVENTION

1. Field of the Invention

This invention relates to cooling towers and particularly to a molded, composite airfoil-defining, synthetic resin blade for large diameter cooling tower fans and having an abrasion resistant leading edge.

2. Description of the Prior Art

Industrial size induced draft water cooling towers have one or more relatively large diameter fans which pull in air from the surrounding atmosphere and direct such air through the water to be cooled by evaporative effect, before discharge of the hot air through a velocity recovery stack. Fans for these applications generally are of a diameter within the range of from about 12 feet to as much as 60 feet or more.

Small diameter cooling fans within the range of from 2 feet to 12 feet in diameter have for the most part been made of metal such as aluminum. Large diameter industrial cooling tower fans having diameters of from 12 feet to as much as 60 feet on the other hand have often been manufactured from fiberglass reinforced synthetic resin in order to reduce the overall weight of the blade and hub assembly. In small diameters, cooling fan blades of aluminum are less expensive than plastic blades. However, for industrial size fan blades, design constraints often preclude the use of aluminum or other metals. Plastics, usually reinforced with materials such as fiberglass, are the construction materials of choice. Aluminum blades for example become too heavy where the blades are to be used in fans having a diameter of 20 feet or more.

Plastic fan blades made up of synthetic resin material reinforced with glass fibers have for the most part been manufactured of an epoxy resin containing fiberglass reinforcement. However, the cost of the resin and the limitations on the use of thermoset type resins such as epoxies, have made epoxy blades very expensive to manufacture and difficult to sell with a reasonable return on the investment.

Polyester fan blades, on the other hand, are less expensive because of the lower price resin, but it has not been heretofore feasible to fabricate polyester having physical and chemical properties commensurate with those of epoxies. Abrasion and consequent deterioration of the leading edge of polyester fan blades has been a particularly vexatious problem.

A need thus exists for a reasonably priced plastic blade for large diameter industrial water cooling tower fan applications manufactured of a polyester resin or the like where the leading edge exhibits adequate abrasion resistance and does not rapidly deteriorate in use while still retaining a requisite surface finish, necessary strength characteristics, required compound curve configuration, adequate strength to weight ratios, and required longevity. Heretofore, these requisites have not been obtainable at a competitive price.

Composite aircraft propellers manufactured of synthetic resin reinforced with glass fiber material and formed over foam cores have been available for a number of years but the problems presented in the manufacture of aircraft blades are significantly different from those encountered in the design and fabrication of significantly longer blades used in industrial cooling towers. Aircraft propellers of plastic materials have relied upon metal leading edge covers of nickel or stainless steel, utilizing technology that has long been practiced in connection with the manufacture of wooden blades. Examples of composite aircraft blades with metal leading edges are illustrated and described in Hartzell Propeller, Inc., U.S. Pat. Nos. 4,102,155 and 4,810,167. Aircraft propellers though sell for a significantly higher cost on a linear basis than can be charged for industrial water cooling tower fans and thus it is not commercially practical to employ the technology that has been developed and is in use for manufacture of water cooling tower fan blades.

SUMMARY OF THE INVENTION

This invention solves a major unresolved problem encountered during manufacture of relatively long polyester type blades for large diameter industrial water cooling towers by providing a unique abrasion resistant leading edge.

The blade body is made up a preformed foam core having a glass fiber reinforced polyester skin over the core. The skin is made up of a series of pre-prepared, flexible sheets of polyester which are laid up over the core so that the layup may be positioned in a mold where curing of the polyester is accomplished under heat while pressure is applied to the blade body.

An elongated protective leading edge member of a polyester base urethane is placed over the leading edge of the polyester skin blade body before placement of the blade layup in the mold so that during curing of the polyester, a firm bonding and adherence of the urethane protective member to the polyester blade body is obtained.

The protective urethane member is provided with a series of openings in opposed longitudinally extending margins thereof so that during curing of the polyester layers to form the blade skin, the polyester resin flows into the openings and solidifies therein which provides a mechanical locking of the member to the blade body throughout the length of the member. Glass fiber reinforced synthetic resin hold-down strips are applied to the outer opposed margins of the abrasion resistant member in overlapping relationship to the skin in order to provide added locking of the member to the blade leading edge.

BRIEF DESCRIPTION OF THE DRAWINGS

FIG. 1 is a fragmentary plan view of an industrial water cooling tower fan illustrating the hub which supports a plurality of the plastic blades of this invention having an abrasion resistant leading edge;

FIG. 2 is an enlarged fragmentary transverse cross-sectional view of one of the blades of FIG. 1 and taken substantially along the line 2—2 of that figure;

FIG. 3 is a fragmentary enlarged plan view of one end of the urethane member which is mechanically locked and chemically bonded to the blade body; and FIG. 4 is a cross-sectional view taken substantially along the irregular line 4—4 of FIG. 3.

DETAILED DESCRIPTION OF THE PREFERRED EMBODIMENT

The plastic fan blade 10 made in accordance with the preferred concepts of the present invention is adapted to be mounted on the hub assembly 12 forming a part of the fan 14 of an industrial type water cooling tower.

Fan 14 is conventionally driven through a gear box (not shown) having an input shaft rotated by a remotely mounted motor (not shown). The output shaft 16 is received within the central hub 18 of assembly 12.

Hub assembly 12, in the embodiment illustrated in the drawings, has a pair of vertically spaced circular plates 20 and 22 which are bolted to the central hub 18. A series of clamp units 24 are located between plates 20 and 22 in radially extending disposition, circumferentially spaced and disposed at the peripheral margins of the plates. Clamp units 24 have separable, generally U-shaped clamp members 26 which are joined by suitable connectors in the form of bolts 28.

As shown in FIG. 1, hub assembly 12 is provided with eight clamp units 24 for mounting of eight separate fan blades 10 in radially extending relationship from the assembly 12. However, it is to be understood that the number of blades is variable depending upon the specifications established for fan 14, including horsepower available, air flow requirements, diameter of the fan, and the nature of the velocity recovery stack 30 in which the fan is caused to rotate.

Viewing FIG. 1, it is to be seen that each of the blades 10 comprises an elongated body 32 which is longitudinally tapered along its length with the shank end 34 being substantially wider than the tip end 36. The taper of the blade is such that the thickness thereof decreases in a direction from the shank end towards the tip end. The leading edge 38 as well as the trailing edge 40 of blade 10 are somewhat arcuate in plan view along the length longitudinally of the blade. Further-more, the blade is desirably transversely arcuate so that the upper surface is somewhat concave while the bottom face is convex as illustrated in FIG. 2.

Blade 10 is of essentially plastic construction with only the cylindrical shank 42 having an internal metallic cylindrical insert.

Each blade 10 includes as major components, a central foam core 44, the cylindrical shank 42 extending from the shank end 34 of blade 10, and an outer skin broadly designated 46.

In the manufacture of blade 10, the synthetic resin foam core 44 is preferably formed in a suitable mold therefor to define the shape as shown in FIGS. 1 and 2. A polyurethane foam cured with an isocyanate catalyst is preferred having a density of from about 2½ to 4 pounds per cubic foot with best results being obtained When the foam has a density of about 3½ pounds per cubic foot. Polyurethane foams allowed to expand without restraint result in a product having a final density of only about ½ pound per cubic foot. However, by forming the foam core in a closed mold under pressure, the density of the core can be closely controlled, and a core produced having a virtually void-free outer face. The molded core is also preferably subjected to a post-cure cycle at a temperature of about 100° F. upon removal of the core from the mold for a time period sufficient to effectively drive off excess isocyanate which could be released and cause voids in the outer skin 46 during final formation of the blade 10.

In most instances it is desirable that the blade 10 be of longitudinally twisted, airfoil-defining configuration. Therefore, although core 44 can be formed 1 in a mold so that the core is in the final desired longitudinally twisted shape of blade 10, equally effective results may be obtained by molding the core in relatively flat condition with reliance being placed on the final mold to form the blade into its twisted configuration, by virtue of the fact that the degree of twist nominally is no more than about 12° from one end of the blade to the other.

The skin 46 is desirably formed of a series of glass fiber reinforced polyester sheets which are laid over the core in the form of pre-prepared, flexible individual sheets which during cure in the mold bond into a laminar, monolithic skin which totally encases the core 44. For exemplary purposes only, skin 44 is preferably fabricated by applying an initial, chemically thickened, internal unidirectional glass fiber polyester sheet or layer 48 to the core 44. The glass fibers of the layer 48 are oriented generally longitudinally of the blade 10 and if desired, a mat of randomly oriented 1" glass fibers may also be incorporated in the sheet 48. The next sheet 50 of glass fiber reinforced synthetic resin material applied to sheet 48 preferably comprises a chemically thickened polyester resin reinforced with a woven glass fiber mat backed up with randomly oriented 1" glass fibers. Optionally, an outer veil layer 52 made up of chemically thickened polyester containing a surface enhancing glass cross-fiber mat and randomly oriented 1" glass fibers may be placed over the layer 52 preparatory to placement of the blade layup into the resin curing mold.

The layer 48 may for example be formulated on a parts by weight basis of about 32 parts of isophthalic polyester resin (e.g., Aristech 14017 resin) along with about 0.33 parts of tertiary-butyl perbenzoate as a curing agent, about 64 parts of stitched unidirectional glass fibers and about part of chopped randomly oriented glass fiber roving having 1" fibers. Additionally, about 0.82 parts of carbon black pigment, 0.979 parts of zinc stearate and 0.979 parts of MgO as thickening agents are incorporated in the formula. The resin layer 48 may for example be about 0.09" thick in its pre-prepared, flexible state.

Layer 50 is desirably of the same composition as layer 48 except that a biaxial woven roving is substituted for the unidirectional fiberglass mat. Layer 50 in its pre-prepared, flexible state is desirably about 0.06" thick.

The veil layer 52 if used may be made up of a pre-prepared, flexible synthetic resin sheet containing on a parts by weight basis about 66 parts of the polyester resin, about 0.66 parts of the tertiary-butyl perbenzoate curing agent, about 4¼ parts of a 10 mil cross-fiber cotton surface mat, and about 21⅓ parts of chopped randomly oriented glass fibers, each about 1" in length. Thickening additives include about 2 parts of zinc stearate, 3⅓ parts of ASP-400-P, about 0.2 parts of CM-2006, and about 2 parts of MgO (e.g., Aristech modifier M, 33% active). The veil layer in its preprepared, flexible state may nominally be of a thickness of about 0.015".

The specific procedure involved in laying up pre-prepared, flexible layers or sheets 48, 50 and 52 may be varied but in the preferred embodiment of the blade 10, separate layers are applied to the portion of core 44 which ultimately is the bottom of the blade 10 in use, while additional independent sheets are applied to what ultimately is the top of the blade core. Overlapping of the individual layers or sheets at the leading and trailing edges of the blade may also be carried out for enhancement of the structural strength of the blade. In like manner, additional layers or sheets may be applied to the blade at the shank end thereof where greater strength is required while the tip end 36 has the three layers shown in FIG. 2.

As a part of the blade layup process, an elongated member 54 of elastomeric material is embedded in the leading edge 38 of blade 10 along a significant part of the length thereof. As is evident from FIG. 1, member 54 may, for example, extend from the tip end 36 of blade 10 through a span length of at least about two-thirds of the longitudinal extent of leading edge 38. However, if desired, member 54 may be of a length to fully cover the leading edge of the final completed The abrasion resistant elastomeric material used for fabrication of member 54 is preferably a polyester base cast urethane with a preferred material being Novitane CU-85 supplied by Novex, Inc. of Wadsworth, Ohio. Novitane CU-85 has the following physical characteristics:

| | ASTM Test Method | CU-85 |
|---|---|---|
| Durometer, Shore A | D-676-49T | 85 |
| Specific Gravity | D-792 | 1.24 |
| Tensile Strength (psi) | D-412-61T | 7500 |
| 300% Tensile Modulus (psi) | D-412-61T | 1700 |
| 200% Tensile Modulus (psi) | D-412-61T | 1000 |
| 100% Tensile Modulus (psi) | D-412-61T | 625 |
| Ultimate Elongation % | D-412-61T | 600 |
| Tear Strength (PLI) | D-624 (Die C) | 450 |
| Compression Set 22 hrs. @ 158° F. Method B | D-395 | 35% |
| Elongation Set | D-412-61T | 15% |
| Water Absorption - 24 hrs. % | D-570 | 0.8 |
| Grease and Oils | | E |
| Organic Solvents | | G-E |
| Resistance Rating | | |
| Water | | |
| to 130° F. | | G |
| 130° F-158° F. | | M |
| High Relative Humidity | | G |
| Sunlight | M | |
| Ozone | E | |
| Heat °F. | | |
| Continuous Loading | | 185° F. |
| Intermittent Loading | | 250° F. |
| Brittle Point (Solenoid) | D-746 | −70° F. |
| Dielectric Constant $10^3$ cps | D-150 | 7.0 |
| Dielectric Strength Volts/mil | D-149 | 450 |
| Volume Resistivity ohm/cm | D-257 | $6 \times 10^{10}$ |
| PICO Abrasion, Index No. | D-2228-69 | 225 |
| Taber Abrasion (mg wt. loss) | D-3389 | 0.027 |

E = Excellent; G = Good; M = Moderate

The member 54 is desirably cast in a form such that it is about ⅛" thick and 6" wide with opposed longitudinally extending relieved, normally outwardly facing margins 54*a* and 54*b* that present stepped surfaces for receiving the edges of respective hold-down strips 62 which overlap opposed margins of member 54 and the adjacent longitudinally extending areas of skin 46 when the member 54 is applied to the leading edge 38 of blade 10. Each of the relieved areas on opposite sides of the member 54 are preferably 1¼" wide. Strips 62 which are each about 4" wide are preferably made up of a chemically thickened, woven glass fiber reinforced polyester having the same composition as the material of layer 50. A veil layer (not shown) reinforced with a thin glass cross-fiber sheet is also placed over each of the hold-down strips 62 and of essentially the same width as each of the latter. Thus, assuming that the hold-down strip 62 is used having a nominal thickness of about 0.060" and a veil layer of about 0.015" in thickness, the composite pre-prepared, flexible hold-down sheet or layer would be about 0.075" thick. Therefore, each of the areas 54*a* and 54*b* should be stepped down from the central portion 54*c* of member 54 a depth of about 0.060" so that there is an additional slight compression of the core 44 directly under the hold-down strips 62.

As is most evident from FIGS. 1 and 2, that leading edge portion 38 of blade 10 which receives elastomeric member 54 is relieved as at 52*a* to a depth to complementally receive the member 54. Thus, the depth of relieved area 52*a* as compared to the main body of blade 10 is approximately equal to the thickness of member 54. Skin 46 of blade 10 also has two upper and lower further relieved areas 52*b* and 52*c* located rearwardly from the relieved area 52*a* of a depth to complementally receive the trailing edge portions of respective hold-down strips 62. It can be perceived from FIG. 2 that the depth of each of the relieved areas 52*b* and 52*c* is approximately the thickness of the hold-down strips 62 so that the outer faces of respective strips are essentially flush with the outer surface of blade 10.

Member 54 is provided with a series of holes 56 through each of the stepped areas 54*a* and 54*b* along the entire longitudinal length of member 54. In its preferred form, member 54 has a series of outboard holes 56*a* in each of the stepped areas 54*a* and 54*b* which are of the stepped areas 54*a* and 54*b* has a series of inboard holes 56*b* also in alignment longitudinally of the member. As is best evident from FIG. 3, adjacent holes 56*a* and 56*b* are in offset relationship longitudinally of the member 54. In a preferred embodiment, each of the holes 56 is a diameter of about ¼". Similarly, the holes are in a pattern such that the center-to-center distance of adjacent holes 56*a* is about 1" and in like manner, the center-to-center distance of adjacent holes 56*b* is about 1". In addition, the distance between lines extending through the centers of aligned holes 56*a* and aligned holes 56*b* is about ½". Holes 56*a* are located about ⅜" from a corresponding outermost edge 58 of member 54.

If desired, a series of 1/16" diameter airbleed apertures 60 may be provided in the central section 54*c* of member 54 between stepped areas 54*a* and 54*b* thereof to allow gaseous materials to escape from beneath member 48 during curing of the polyester resin making up the layers defining skin 46.

Although Novitane CU-85 is the preferred urethane material for fabrication of member 54, it is to be understood that other materials may be substituted in this respect. The member however should have a Shore A durometer value within the range of about 70 to 90 when tested in accordance with ASTM Test Method D-676-49T.

Upon completion of the layup of the flexible synthetic resin layers over core 44, including member 58 in at least partial covering relationship to leading edge 38 of blade 10, the blade layup is inserted in a mold having a cavity which defines the final airfoil shape of the blade. Curing of the polyester resin is accomplished by subjecting the blade layup to a curing temperature of from about 250° F. to 350° F. and desirably about 270° F. for a time period of 25 to 60 minutes and preferably about 45 minutes. The blade is retained in the mold at the elevated temperature while pressure in the order of about 125 psi to about 225 psi and preferably about 175 psi is applied to the blade to effect compression of the core 44. During curing of layers 48, 50, 52 and 62 at the elevated temperature of the mold, and while member 54 is maintained in the desired final disposition thereof overlying the synthetic resin layers making up skin 46, the layers 48, 50, 52 and 62 laminate and to a certain degree coalesce into a laminar, monolithic outer skin. At the same time, the member 54 becomes mechanically attached to the resin layers of skin 46 by virtue of the fact that the polyester resin making up the skin flows into and completely fills each of the openings 56 in member 54. The polyester synthetic resin material from the underlying skin layer which flows into each of the holes 56 to completely fill the same with polyester, also cross-links with the resin of the overlying hold-down strip so that, upon removal of the blade 10 from the curing mold, after full solidification and curing of the resin making up the skin 46, the portions of such polyester material that extend into each of the openings 56 firmly affix and bond the urethane leading edge protective member 54 to the leading edge 38 of blade 10. Cross-linking of the polyester resin which fills each of the holes 56, with resin layers above and below such plugs materially enhances the mechanical attachment of opposed margins of the member 54 to blade leading edge 38.

In like manner, the internal surface of member 54 in engagement with the polyester resin therebeneath is adhesively bonded to the polyester layer by virtue of the fact that the polyester undergoes curing while in firm adhering relationship with the inside face of member 54. Upon solidification and curing of the polyester resin, the intimate contact thereof with the internal face of member 54 assures a firm bond between such surface and the adjacent part of the polyester resin. Furthermore, the hold-down strips 62 cross-link and laminate with the other layers of the skin 46 to form a laminar, monolithic layer firmly bonded to the areas 54*a* and 54*b* of member 54 which assists in firm affixation of the member 54 to skin 46.

In order to enhance bonding of the inner face of the member 54 to the underlying polyester layer, before placement of member 54 against the leading edge 38 of blade 10, the normally innermost face of the urethane elastomer making up member 54 may be wiped with a solvent such as methylene chloride, acetone, methylethyl ketone or similar solvents.

After removal of the cured blade 10 with an abrasion resistant leading edge comprising a urethane strip or member 54 on the leading edge 38 thereof, the blade is allowed to cool and then the margins of the blade may be dressed down as may be necessary to assure a smooth marginal surface around the entire perimeter of the blade.

It is to be understood that in addition to the preferred embodiment, alternative thermoset blade skin and hold down strip resins may be substituted for the isocyanate polyesters described above. Examples are vinyl esters, or epoxies. Similarly, alternative manufacturing techniques may be employed such as, but not restricted to, resin transfer, autoclaving, wet layup or hand layup.

In like manner, materials other than polyester base urethane may be used to fabricate the member 54. Exemplary materials in this respect include polyethylene, polypropylene, neoprene, or other similar elastomeric materials.

We claim:

1. In a glass fiber reinforced, synthetic resin fan blade for large diameter industrial water cooling tower fans, wherein the outer body portion of the blade is constructed of a thermoset resin and has upper and lower surfaces of which a part thereof define an elongated leading which would be subject to abrasion deterioration during use of the blade, the improvement comprising:

an elongated protective outermost sheet member having opposed, longitudinally extending edges and wrapped over at least a part of the longitudinal extent of the leading edge of the blade with one of the longitudinally extending edges of the member overlying the upper surface of the blade outer body portion and the other longitudinally extending edge of the member on the lower surface of the blade outer body portion, said member being bonded to the blade outer body portion throughout the transverse and longitudinal extent of the member, said member being fabricated of a flexible, urethane elastomer material which is more resistant to impact the abrasion during use of the blade under the operating conditions thereof than the resin making up the outer blade body portion; and means for mechanically attaching the member to the blade outer body portion substantially throughout the length of the member, said means for attaching the member to the blade outer body portion including upper and lower hold down strips of a synthetic resin and disposed in overlying relationship to the longitudinally extending edges of the member on the upper and lower surfaces of the blade outer body portion and over the longitudinally extending areas of the blade outer body portion which are adjacent respective longitudinally extending edges of the member, said member being provided with a series of openings therein, said openings being located adjacent and along both of the opposed longitudinally extending edges of the member substantially throughout the length of said member, the thermoset resin making up the blade outer body portion extending through respective openings in the member and being joined with an overlying hold down strip.

2. A fan blade as set forth in claim 1, wherein said member is of a material having a Shore A durometer value of from about 75 to 90.

3. A fan blade as set forth in claim 1, wherein said member is of a material having a Shore A durometer value of about 85.

4. A fan blade as set forth in claim 1, wherein said member is of a polyester base urethane elastomer.

5. A fan blade as set forth in claim 1, wherein said member is of a polyester base urethane elastomer having a Shore A durometer value of about 85, a tensile strength of about 7500 psi, a PLI tear strength of about 450, a PICO abrasion index number of about 225, and a Taber abrasion weight loss of about 0.027 mg.

6. A fan blade as set forth in claim 1, wherein said member is a polyester base urethane resin about ⅛" thick.

7. A fan blade as set forth in claim 6, wherein said member is approximately 6" wide.

8. A fan blade as set forth in claim 1, wherein said hold-down strips are reinforced with glass fibers.

9. A fan blade as set forth in claim 8, wherein said hold-down strips are constructed of a thermostat resin reinforcement with woven fiberglass matting.

10. A fan blade as set forth in claim 1, wherein said openings in each of the series thereof are arranged in an offset pattern longitudinally of the blade.

11. A fan blade as set forth in claim 1, wherein said openings are each about ¼" in diameter and located in disposition such that their centers are about ½" apart in a direction longitudinally of the blade.

12. A fan blade as set forth in claim 1, wherein said member is attached to the outer body portion of the blade by bonding of the member with the resin of the outer body portion of the blade during curing of said resin.

13. A fan blade as set forth in claim 1, wherein the leading edge of said outer body portion of the blade is relieved to an extent to receive the member in disposition such that the outer surface of the member is generally flush with the outer surface of the outer body portion of the blade, said outer body portion of the blade being provided with upper and lower elongated relieved areas extending longitudinally of the body portion of the blade and complementally receiving respective opposed, longitudinally extending rear margins of corresponding overlying and underlying said hold-down strips, said member being provided with elongated, upper and lower relieved areas extending longitudinally of the member and receiving respective opposed, longitudinally extending front margins of corresponding hold-down strips, said hold-down strip receiving relieved areas inn the outer body portion of the blade and in said member being of a depth such that the outer surfaces of the hold-down strips are generally flush with the outer surface of the outer body portion of the blade and with the outer surface of the member respectively.

14. In a method of fabricating a glass fiber reinforced, synthetic resin fan blade for large diameter industrial water cooling tower fans, the steps of:

preparing a blade body having an outer body portion of a glass fiber reinforced synthetic resin material of a thermoset type, said outer portion of the blade body having upper and lower surfaces of which a part thereof define an elongated leading edge which in the final cured state of said resin would be subject to leading edge abrasion during use of the blade;

providing an elongated protective sheet member of flexible, urethane elastomer material having opposed, longitudinally extending edges, said member being more resistant to impact and abrasion during use of the blade than the cured resin material making up the blade outer body portion;

wrapping said sheet member around at least a portion of said longitudinally extending leading edge of the blade outer body portion in disposition defining the outermost surface of the blade and located in at least partial covering relationship to the leading edge thereof with one of the longitudinally extending edges of the member overlying said upper surfaces of the blade outer body portion and the other longitudinally extending edge of the member on said lower surface of the blade outer body portion;

applying upper and lower hold down strips of thermoset resin in overlying relationship to the longitudinally extending upper and lower edges of the member and the longitudinally extending areas of the blade outer body portion which are adjacent respective longitudinally extending edges of the member, said member being provided with a series of openings therein, said openings being located adjacent and along both of the longitudinally extending edges of the member substantially throughout the length of said member; and curing said synthetic resin blade outer body portion while the member is in place over the leading edge of the blade outer body portion to effect bonding of the flexible material to said outer portion of the blade body and causing the resin material making up the hold down strips and said outer blade body portion to flow through and fill said openings thereby providing a mechanical attachment of the member to the blade outer body portion upon curing of the blade outer body portion and hold down strip resin material.

15. A method of fabricating a fan blade as set forth in claim 14, wherein is included the step of providing a series of apertures in said member intermediate the openings on opposite sides of the member to allow escape of gaseous materials that might otherwise tend to accumulate between the member and the blade outer body portion.

16. A method of fabricating a fan blade as set forth in claim 14, wherein said curing of the outer portion of the blade body is carried out while pressure is applied against the member to assure firm adherence of the member to the outer portion of the blade body.

17. A method of fabricating a fan blade as set forth in claim 16, wherein about 125 to about 225 psi pressure is applied to the member during curing of the synthetic resin outer portion of the blade body.

* * * * *